US006835517B2

(12) United States Patent
Kondo et al.

(10) Patent No.: US 6,835,517 B2
(45) Date of Patent: Dec. 28, 2004

(54) TONER, DEVELOPER AND IMAGE FORMING METHOD USING THE TONER

(75) Inventors: Maiko Kondo, Shizuoka-ken (JP); Yasuaki Iwamoto, Shizuoka-ken (JP); Fumihiro Sasaki, Shizuoka-ken (JP); Hiroto Higuchi, Shizuoka-ken (JP); Bing Shu, Shizuoka-ken (JP); Yasushi Koichi, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 103 days.

(21) Appl. No.: 10/151,103

(22) Filed: May 21, 2002

(65) Prior Publication Data

US 2003/0082472 A1 May 1, 2003

(30) Foreign Application Priority Data

May 21, 2001 (JP) ..... 2001-151166
Jun. 8, 2001 (JP) ..... 2001-174846

(51) Int. Cl.[7] ..... G03G 9/087

(52) U.S. Cl. ..... 430/108.3; 430/108.4; 430/108.8

(58) Field of Search ..... 430/108.3, 108.4, 430/108.8

(56) References Cited

U.S. PATENT DOCUMENTS

| | | | | |
|---|---|---|---|---|
| 4,758,489 | A | 7/1988 | Tomita et al. | |
| 4,908,290 | A | 3/1990 | Watanabe et al. | |
| 4,980,258 | A | 12/1990 | Aoki et al. | |
| 5,225,303 | A | 7/1993 | Tomita et al. | |
| 5,840,456 | A | 11/1998 | Tomita et al. | |
| 6,074,795 | A | 6/2000 | Watanabe et al. | |
| 6,103,441 | A | 8/2000 | Tomita et al. | |
| 6,168,894 | B1 | 1/2001 | Aoki et al. | |
| 6,180,298 | B1 | 1/2001 | Kuroda et al. | |
| 6,183,926 | B1 | 2/2001 | Kuroda et al. | |
| 6,228,550 | B1 | 5/2001 | Matsuda et al. | |
| 6,258,502 | B1 | 7/2001 | Nakamura et al. | |
| 6,303,257 | B1 | 10/2001 | Hasegawa et al. | |
| 6,335,137 | B1 | 1/2002 | Suzuki et al. | |
| 6,337,957 | B1 | 1/2002 | Tamaki et al. | |
| 6,360,068 | B1 | 3/2002 | Kinoshita et al. | |
| 6,363,229 | B1 | 3/2002 | Shiraishi et al. | |
| 6,395,443 | B2 | 5/2002 | Kuroda et al. | |
| 6,410,198 | B1 * | 6/2002 | Sawano et al. | 430/108.3 |
| 6,432,589 | B1 | 8/2002 | Uchinokura et al. | |
| 6,442,364 | B2 | 8/2002 | Kai et al. | |
| 6,505,014 | B2 | 1/2003 | Aoki et al. | |
| 6,507,718 | B2 | 1/2003 | Ohjimi et al. | |
| 6,656,654 | B2 * | 12/2003 | Higuchi et al. | 430/108.3 |

FOREIGN PATENT DOCUMENTS

| | | |
|---|---|---|
| EP | 1 074 890 | 2/2001 |
| JP | 05-173354 | 7/1993 |
| JP | 06-161144 | 6/1994 |
| JP | 07-287420 | 10/1995 |
| JP | 08-15907 | 1/1996 |
| JP | 09-197715 | 7/1997 |

* cited by examiner

*Primary Examiner*—Mark A. Chapman
(74) *Attorney, Agent, or Firm*—Oblon, Spivak, McClelland, Maier & Neustadt, P.C.

(57) ABSTRACT

A toner including at least a binder resin; a colorant; a charge controlling agent; and a wax (B), in which the charge controlling agent comprises a compound selected from the group consisting of: an aromatic oxycarboxylic acids, derivatives of aromatic oxycarboxylic acid, salts of aromatic oxycarboxylic acids and salts of derivatives of aromatic oxycarboxylic acids; and a zirconium compound (A), and in which the zirconium compound (A) and the wax (B) have a weight ratio (A/B) satisfying the following relationship:

$$3.0 \leqq (A/B) \times 100 \leqq 60.0$$

23 Claims, 1 Drawing Sheet

TONER, DEVELOPER AND IMAGE FORMING METHOD USING THE TONER

BACKGROUND OF THE INVENTION

1. Field of the Invention

The present invention relates to a toner for developing an electrostatic latent image in image forming methods such as electrophotographic methods, electrophotographic recording methods and electrophotographic printing methods.

2. Discussion of the Background

Conventionally, the electrophotographic method is typically a method in which (1) an electrostatic latent image is formed on a photoreceptor formed from a photoconductive material by various means; (2) the electrostatic latent image is developed with a toner to form a toner image; (3) the toner image is optionally transferred onto a transfer sheet such as papers; and (4) the toner image is fixed on the transfer sheet by heating and pressurizing or a solvent vapor deposition to form a copy image.

As a method of fixing the toner image on the transfer sheet upon application of heat, a heating roller fixing method is widely used because of its high energy efficiency. Recently, a system in which a power for the heat source is turned off at a standby time when the fixation is not performed is used for saving energy. In such a system, the heating roller has to be heated and have a desired temperature in quite a short time immediately after the power for the heat source is turned on. Therefore, a fixer used in such a system has to have high heat-energy efficiency and trials are made to make a portion of the fixing roller contacting the toner image supporting face thin. Such trials have enabled the fixing roller to reach the desired temperature in quite a short time.

However, mechanical strength of the roller weakens due to its thinness and a large load cannot be applied thereto. In order to operate such a fixer without problem, a toner has to be fixed at a much lower temperature than that of a conventional toner because heat energy is an essential factor for fixing. Therefore, trials to improve low-temperature fixability of a toner using a resin having a low softening point is typically made. However, when such a resin is used, a fixable temperature becomes lower on the whole and it is difficult to maintain good fixability only by an improvement of a resin.

In order to solve this problem, a wax is conventionally included in a toner to have releasability. In order to sufficiently exert performance of the wax, it is quite important to moderately control dispersed condition thereof on a surface of a toner. When an amount of the wax present on the surface of a toner is large, releasability of the toner due to the wax increases by a heat in fixing. Therefore, the toner has good offset resistance, but at the same time, spent-wax on a carrier and filming over a photoreceptor and a developing sleeve occur to cause a problem in producing a good quality image.

In order to solve these problems, various methods have been suggested, e.g., Japanese Laid-Open Patent Publication No. 8-15907 discloses a method in which fine particles including a part of colorant and a release agent, and a toner composition are mixed in the preliminary mixing process; and Japanese Laid-Open Patent Publications Nos. 9-197715 and 7-287420 disclose a method of pulverizing uniformly with a specific condition in the kneading process. In addition, Japanese Laid-Open Patent Publication No. 5-173354 discloses properties, addition quantity and kinds of a release agent; and Japanese Laid-Open Patent Publication No. 6-161144 discloses dispersed condition of a release agent in a toner.

However, any of these methods does not satisfy both filming and offset resistance.

In addition, recently many copiers have additional printer functions and only one copy or print is often produced. Therefore, a developer agitating time becomes longer for the number of copies and prints. Particularly, in a mode to produce one copy for one original (it is called as 1 to 1 copy and low Duty mode), the developer agitating time per one copy is not less than 4 sec which is 2 to 8 times as long as that of continuous copying while the photoreceptor is rotating at a speed of 150 to 760 mm/sec. In such a mode, a heat stress between the developer and the developer regulating member becomes large, resulting in blocking where the toners mutually melted and solidified; shortening the longevity of the developer; and filming over the photoreceptor.

Because of these reasons, a need exists for a heat resistant toner having a low temperature fixability and stably producing good quality images.

SUMMARY OF THE INVENTION

Accordingly, an object of the present invention is to provide a heat resistant toner having a low temperature fixability and stably producing good quality images even in an image forming apparatus where the fixer has a low surface pressure and the developer agitating time is so long as to give much heat stress thereto.

Another object of the present invention is to provide an image forming method using the toner.

Briefly this object and other objects of the present invention as hereinafter will become more readily apparent can be attained by a toner including at least; a binder resin, a colorant, a charge controlling agent and a wax (B); in which the charge controlling agent includes at least a compound selected from the group consisting of; an aromatic oxycarboxylic acids, derivatives of thereof, salts thereof and salts of the derivatives thereof; and a zirconium compound (A), and in which the zirconium compound (A) and the wax (B) have a weight ratio (A/B) satisfying the following relationship:

$$3.0 \leqq (A/B) \times 100 \leqq 60.0$$

These and other objects, features and advantages of the present invention will become apparent upon consideration of the following description of the preferred embodiments of the present invention taken in conjunction with the accompanying drawing.

BRIEF DESCRIPTION OF THE DRAWING

Various other objects, features and attendant advantages of the present invention will be more fully appreciated as the same becomes better understood from the detailed description when considered in connection with the accompanying drawing in which like reference characters designate like corresponding parts throughout and wherein.

DETAILED DESCRIPTION OF THE INVENTION

Figure 1:
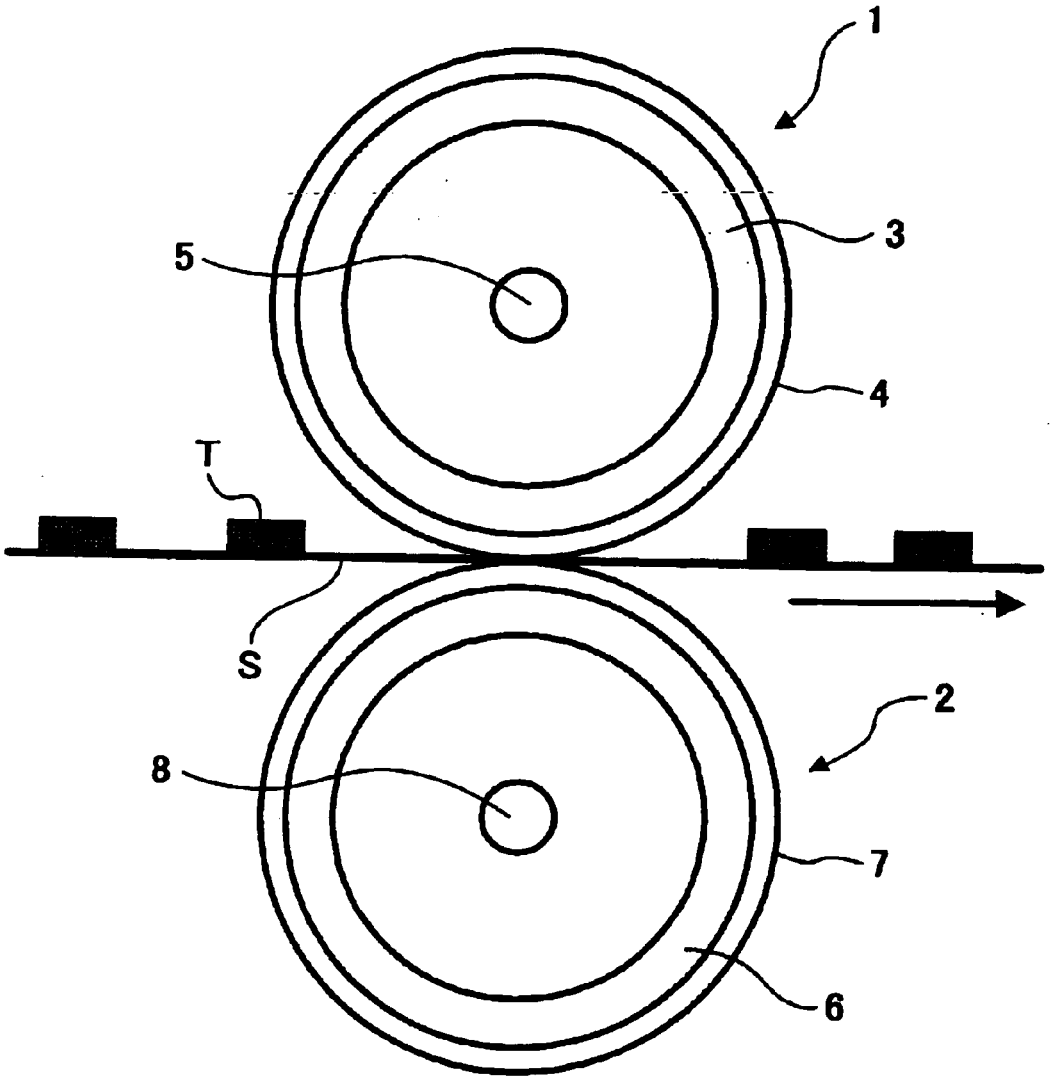
FIG. 1 is a schematic view illustrating an embodiment of the fixer used in the present invention.

Generally, the present invention provides a toner having a low temperature fixability and stably producing good quality images even in an image forming apparatus where the fixer has a low surface pressure and the developer agitating time is so long as to give much heat stress thereto. In addition, an image forming method using the toner is provided.

Properties of a toner including a release agent largely change according to the dispersed condition thereof. When the release agent in the toner has a small particle diameter and is uniformly dispersed therein, the release agent amount present on the surface of the toner is equivalent to that of the release agent therein. However, when the release agent has a large particle diameter, the release agent amount present on the surface of the toner is larger than that of the release agent therein. This is because when the kneaded toner is pulverized to fine particles, an outside force such as mechanical shock and jet stream shock are often used for the pulverization. When the toner receives an outside force, the weakest part inside the toner breaks. Since the weakest part is the release agent, the release agent on the surface of the toner and fine-powder of the release agent increase when the release agent having a large particle diameter is present in the toner, and therefore filming further tends to occur.

The present inventors discovered that the toner has good fixability and filming can be decreased when the zirconium compound (a) and the wax (B) both included in the toner have the above-mentioned weight ratio. This is because it is thought that portions having high reactivity of the zirconium compound (A) and the wax (B) are combined and the wax is dispersed in accordance with the fine dispersion of the zirconium compound, and therefore the dispersed condition of the wax can be uniformly maintained. The zirconium compound and the wax have a stable affinity when the kneading temperature is properly maintained and the wax has uniform dispersibility.

When the weight ratio between the zirconium compound (A) and the wax (B), i.e., (A/B)×100 is less than 3.0, the zirconium compound is not sufficient enough to fully disperse the wax (B) and the dispersed particle diameter of the wax becomes uneven. Therefore, spent of the wax having a large dispersed particle diameter on the surface of the carrier tends to occur, resulting in occurrence of abnormal images due to the insufficiently charged toner. When (A/B)×100 is greater than 60.0, the wax (B) are combined and the zirconium compound (A) and combined so much that the excessively dispersed wax cannot sufficiently exert its original function and the fixability of the toner deteriorates.

In addition, the weight ratio between the zirconium compound (A) and the wax (B), i.e., (A/B)×100 is preferably from 5 to 40, and more preferably from 10 to 30.

Further, particularly when the zirconium compound having the following formula (1), for example, a hydroxyl group of the wax and a carboxyl group of the zirconium compound are combined, so that the wax is dispersed in accordance with the dispersion of the zirconium compound and the dispersibility thereof becomes more uniform.

(1)

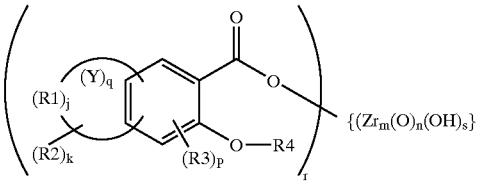

wherein R1 represents a quaternary carbon atom, a methine group or a methylene group, and optionally includes a hetero atom of N,S,O and P; Y represents a group having a ring including a saturated bonding or unsaturated bonding (for example, benzene); R2 and R3 independently represent an alkyl group, an alkenyl group, an alkoxy group, an aryl group, a substituted aryl group, an aryloxy group, a substituted aryloxy group, an aralkyl group, a substituted aralkyl group, an aralkyloxy group, or a substituted aralkyloxy group, a halogen group, a hydroxy group, an amino group, a substituted amino group, a carboxyl group, an alkoxycarbonyl group, a nitro group, a nitroso group, a sulfonyl group or a cyano group; R4 represents a hydrogen atom or an alkyl group; j is 0 or an integer of from 3 to 12; k is 0 or an integer of from 1 to 4; m is an integer of from 1 to 20; n is 0 or an integer of from 1 to 20; p is 0 or an integer of from 1 to 4; q is 0 or an integer of from 1 to 3; r is an integer of from 1 to 20; and s is 0 or an integer of from 1 to 20. In formula (1) Y is part of the ring including R1.

In addition, the present inventors discovered that there is a relationship between wax amount present on surfaces of toner particles and surface friction coefficient thereof. The more the wax amount present on surfaces of toner particles, the lower the surface friction coefficient thereof. In the present invention, the toner is tabularly formed upon application of pressure to measure the friction coefficient of the surface thereof. This is also a substitute of a load onto the toner in an actual image forming apparatus and the stability of the toner therein can be known. The toner preferably has a surface friction coefficient of from 0.20 to 0.40

When the surface friction coefficient of the toner is less than 0.20, the wax amount present on the surface thereof is so much that the wax moves to the carrier and the photoreceptor, and spent-carrier and photoreceptor filming tend to occur. When greater than 0.40, the releasability of the release agent is insufficient and hot offset tends to occur. The surface friction coefficient of the present invention is a static friction coefficient using an automatic friction and abrasion analyzer named DFPM-SS manufactured by Kyowa Interface Science Co., Ltd. as a measuring instrument and a stainless ball as a terminal.

A content of the wax is typically from 0 to 15 parts by weight, however, in the present invention, preferably from 0 to 5 parts by weight, and more preferably from 3 to 5 parts by weight per 100 parts by weight of the resin included in the toner. Such an amount of the wax can properly control the amount thereof present on the surface of the toner, and both filming and offset resistance are further increased. The dispersed particle diameter of the wax can be controlled by, e.g., the addition quantity; a way of applying shearing strength in kneading such as kneading temperature and time; or cooling and pulverizing conditions.

In addition, the wax of the present invention preferably has a dispersed particle diameter of from 0.1 $\mu$m to 1.5$\mu$. In the present invention, the maximum particle diameter of the wax is determined as the dispersed particle diameter thereof. A method of measuring the dispersed particle diameter is as follows:

(1) 100 toner particles randomly selected are buried in an epoxy resin and the resin is sliced into an ultrathin section having a thickness of about 100 $\mu$m;

(2) the section is dyed with ruthenium tetroxide and observed with a transmission electron microscope (TEM) at 10,000 times magnifications; and (3) the section is photographed to observe the condition of the dispersed wax and measure the average particle diameter.

When the dispersed particle diameter is less than 0.1 $\mu$m, the toner does not perform sufficient releasability and have a problem in its fixability. When there are many particles having dispersed particle diameters greater than 1.5 μm, spent-carrier and filming over the photoreceptor occasionally occur.

As a wax dispersed in the toner of the present invention, a carnauba wax, a rice wax or an ester wax is preferably used. These waxes have better low-temperature fixability than the other waxes.

The carnauba wax is a natural wax obtained from carnauba palm fronds, and particularly it is more preferable to use a carnauba wax which a free fatty acid is released from and has a low acid value because it can be uniformly dispersed in the binder resin, and because it prevents filming over a photoreceptor and spent-toner over a charging member owing to its low volatile components.

The rice wax is a natural wax obtained from a refinery of a crude wax formed in a dewaxing or a wintering process when a bran oil extracted from a rice bran is refined.

The synthetic ester wax is synthesized by an esterification reaction between a monofunctional normal fatty acid and a monofunctional normal alcohol.

These waxes can be used alone or in combination, usage amount of the wax in the present invention is a total amount of the waxes when used in combination.

In addition, it was found that when the toner includes a chloroform-insoluble compound of from 2 to 45% by weight, the toner can have a good hot offset resistance without damaging its low temperature fixability in an environment where there is much heat stress. When the toner includes the chloroform-insoluble compound less than 2% by weight, the toner has the hot offset problem. When the toner includes the chloroform-insoluble compound greater than 45% by weight, the heat resistance and the hot offset resistance thereof are improved, but the low temperature fixability thereof deteriorates.

In addition, it was found that the toner having a volume-average particle diameter of from 5 to 10 μm and including a content of the toner particles having a particle diameter not greater than 5 μm of from 60 to 80% by number has good fixability and can maintain to produce images having good quality even in an environment where there is much heat stress. When the content of the toner particles having a particle diameter not greater than 5 μm is less than 60% by number, image quality stability such as thin line reproducibility occasionally deteriorates. When the content of the toner particles having a particle diameter not greater than 5 μm is greater than 80% by number, uniform quality of the toner is damaged and charge stability thereof deteriorates to occasionally cause deterioration of image density of the produced images.

The toner of the present invention preferably includes a polyester resin not less than 50% by weight as a resin component. The polyester resin is a suitable binder resin of the present invention because the polyester resin typically has better fixability as well as better heat resistant preservability than the other resins.

When the toner of the present invention forms a two-component developer together with a carrier, the surface of the carrier is preferably coated with a silicone resin. Conventionally, carries coated with various resins have been suggested to prevent spent-toner onto the surface thereof. Among these carriers, a silicone-coated carrier has an extremely high effect on spent-wax.

In addition, FIG. 1 is an embodiment of a fixer used in the present invention. In FIG. 1, a fixing roller 1 is formed of a metallic cylinder 3 made of a heat conductive material such as aluminium, iron, stainless and brass. An offset preventing layer formed from RTV, silicone rubber, tetrafluoroethylene-perfluoroalkylvinylether(PFA), polytetrafluoroethylene (PTFE), etc. is coated on the surface of the material. Inside the fixing roller 1, a heat lamp is arranged. A metallic cylinder 6 of a pressure roller 2 is formed of the same material as that of the fixing roller 1 in many cases, and the surface thereof is coated with a offset preventing layer 7 formed from PFA and PTFA, etc. In addition, inside the pressure roller 2, a heat lamp 8 is optionally arranged.

The fixing roller and the pressure roller are rotated while pressed against each other by springs (not shown) at both ends thereof. A support S (a transfer sheet such as a paper) on which a toner image T is adhered is passed between the fixing roller 1 and the pressure roller 2, and the toner image T is fixed on the support S.

The fixer used in the present invention has a fixing roller formed of a metallic cylinder having a thickness not greater than 1.0 mm. Therefore, property of temperature build-up of the fixing roller is improved and the fixing roller can have a desired temperature in quite a short time.

The fixing roller preferably has a thickness of from 0.2 to 0.7 mm although this differs according to strength and heat conductivity of a material used therefor.

In addition, a load applied between the fixing roller and the pressure roller (surface pressure) is preferably not greater than $1.5\times10^5$ Pa. The surface pressure is determined by dividing a load applied to both ends of the rollers by contact area of the rollers.

The roller contact area is determined as follows:

(1) a sheet like an OHP sheet whose surface largely changes by heating is passed through the rollers having a fixable temperature; and (2) after the sheet is stopped on the way for several decade seconds, it is delivered to determine an area of the surface changed portion.

The higher the surface pressure, the more advantageous for fixing a toner image. However, a large load cannot be applied to the above-mentioned fixer including a fixing roller formed of a metallic cylinder having a thickness of not greater than 1.0 mm because the roller is deformed by a large load. Therefore, the load is preferably not greater than $1.5\times10^5$ Pa, and more preferably from 0.5 to $1.0\times10^5$ Pa.

Next, materials used in the toner of the present invention will be explained in detail.

The polyester resin for use in the present invention is obtained from a condensed polymerization between alcohol and a carboxylic acid. Specific examples of the alcohol include glycol such as ethyleneglycol, diethyleneglycol, triethyleneglycol and propyleneglycol; etherified bisphenol such as 1,4-bis(hydroxymethyl)cyclohexane and bisphenol A; units obtained form a dihydric alcohol monomer; and units obtained from a tri-or-more hydric alcohol monomer. Specific examples of the carboxylic acid include units obtained from a dihydric organic-acid monomer such as maleic acid, fumaric acid, phthalic acid, isophthalic acid, terephthalic acid, succinic acid and malonic acid; and units obtained from a tri-or-more hydric carboxylic-acid monomer such as 1,2,4-benzenetricarboxylic acid, 1,2,5-benzenetricarboxylic acid, 1,2,4-cyclohexanetricarboxylic acid, 1,2,4-naphthalanetricarboxylic acid, 1,2,5-hexanetricarboxylic acid, 1,3-dicarboxyl-2-methylenecarboxypropane and 1,2,7,8-octantetracarboxylic acid. The polyester resin preferably has a glass transition temperature (Tg) not lower than 55° C., and more preferably not lower than 60° C.

A resin besides the polyester resin can be used together as a resin component in the toner of the present invention unless the resin damages the performance thereof.

Specific examples of such resins include styrene resins (polystyrene, or homopolymers or copolymers including a styrene substituent) such as polystyrene, chloropolystyrene, poly$\chi$-methylstyrene, styrene-chlorostyrene copolymers, styrene-butadiene copolymers, styrene-vinylchloride copolymers, styrene-vinylacetate copolymers, styrene-maleic acid copolymers, styrene-ester acrylate copolymers (styrene-methylacrylate copolymers, styrene-ethylacrylate copolymers, styrene-butylacrylate copolymers, styrene-octylacrylate copolymers, styrene-phenylacrylate copolymers, etc.), styrene-ester methacrylate copolymers (styrene-methylmethacrylate copolymers, styrene-ethylmethacrylate copolymers, styrene-butylmethacrylate copolymers, styrene-phenylmethacrylate copolymers, etc.), styrene-$\chi$-methylchloroacrylate copolymers and styrene-acrylonitrile-ester acrylate copolymers; vinylchloride resins; styrene-vinylacetate copolymers; rosin-modified maleic acid resins; phenol resins; epoxy resins; polyethylene resins; polypropylene resins; ionomer resins; polyurethane resins; silicone resins; ketone resins; ethylene-ethylacrylate copolymers, xylene resins; polyvinylbutyral resins; petroleum reins; hydrogenated petroleum resins, etc.

These resins can be used alone or in combination and are not limited thereto. In addition, a manufacturing method of these resins is not particularly limited and any methods such as mass polymerization, solution polymerization, emulsion polymerization and suspension polymerization can be used.

As a colorant for use in the present invention, any known dyes and pigments such as carbon black, lamp black, iron black, aniline blue, Phthalocyanine Blue, Phthalocyanine Green, Hansa Yellow G, Rhodamine 6C Lake, chalco Oil Blue, chrome yellow, quinacridone, Benzidine Yellow, Rose Bengal and triallylmethane dyes can be used alone or in combination for a black toner and a full color toner.

A content of these colorants is preferably from 1 to 30% by weight, and more preferably from 3 to 20% by weight per 100% by weight of the resin of the toner.

A typical method of manufacturing the zirconium of the present invention is as follows:

(1) an aromatic oxycarboxylic acid or its derivatives or their salts and a compound including zirconium or oxyzirconium(metal imparting agent) are reacted in water and/or an organic solvent; and (2) the reacted product is filtered and washed to form the zirconium compound.

Specific examples of the aromatic oxycarboxylic acids for use in the present invention include 3,5-di-t-butylsalicylic acid, 3,5-di-I-propylsalycilic acid, 5-methoxysalicylic acid, 3,5-dichlorosalicylic acid, 3-t-butyl-5-methylsalicylic acid, 2-hydroxy-3-naphthoic acid, 2-hydroxy-6-t-butyl-3-naphthoic acid, etc. Specific examples of the derivatives of the aromatic oxycarboxylic acids include an aromatic oxycarboxylic acid whose hydroxyl group is substituted by an alkoxy group, etc. and the alkoxy group includes methoxy groups and ethoxy groups. In addition, specific examples of the salts of the aromatic oxycarboxylic acids or their derivatives include alkali metallic salts, etc. Specific examples of the derivatives of the aromatic oxycarboxylic acid include an aromatic oxycarboxylic acid whose hydroxyl group is substituted by an alkoxy group, etc. where the alkoxy group includes methoxy groups and ethoxy groups. In addition, specific examples of the salts of the aromatic oxycarboxylic acids or their derivatives include alkali metallic salts, etc. Specific examples of the metal imparting agents include halogenated zirconium compounds such as $ZrCl_4$, $ZrF_4$, $ZrBr_4$ and $ZrI_4$, and inorganic zirconium compounds such as $Zr(OR)_4$ (R represents an alkyl group and an alkenyl group) or $Zr(SO_4)_2$ for quadrivalent cationic materials; and inorganic acid zirconium compounds such as $ZrOCl_2$, $ZrO(NO_3)_2$, $ZrO(ClO_4)_2$, $H_2ZrO(SO_4)_2$, $ZrO(SO_4)\cdot Na_2SO_4$ and $ZrO(HPO_4)_2$, and organic acid zirconium compounds such as $ZrO(CO_3)$, $(NH_4)_2ZrO(CO_3)_2$ $(NH_4)_2ZrO(C_2H_3O_2)_2$, $ZrO(C_2H_{35}O_2)_2$ and $ZrO(C_{18}H_{35}O_2)_2$.

As a fluidity improver for use in the present invention, any known fluidity improvers such as silicon oxide, titanium oxide, silicon carbide, aluminium oxide and barium titanate can be used alone or in combination. A content of these fluidity improvers is preferably from 0.1 to 5 parts by weight, more preferably from 0.5 to 2 parts by weight per 100 parts by weight of the toner.

As a carrier for a two-component developer including the toner of the present invention, any known carriers can be used. For example, magnetic powders such as an iron powder, a ferrite powder and a nickel powder; glass beads; and these materials coated with a resin can be used.

Specific examples of the resin powders which can be coated on the carrier in the present invention include styrene-acryl copolymers, silicone resins, maleic acid resins, fluorocarbon resins, polyester resins, epoxy resins, etc. The styrene-acryl copolymers preferably has a content of styrene of from 30 to 90% by weight. When the styrene is less than 30%, the developing properties deteriorate. When the styrene is greater than 90% by weight, the coated layer becomes hard and easy to peel off, resulting in short-life of the carrier.

In addition, the coating material on the carrier in the present invention may include an adhesion imparting agent, a hardener, a lubricant, a conductive material, a charge controlling agent, etc. besides the above-mentioned resins.

Next, measuring methods used in the present invention will be explained.

(1) Surface Friction Coefficient of Toner

Three grams of a toner is put into a tablet forming dice and a pressure of 6 tons is applied thereto for 1 min to prepare a tabular toner pellet.

The surface friction coefficient of the toner is determined by measuring a static friction coefficient of the pellet with an automatic friction and abrasion analyzer (DFPM-SS manufactured by Kyowa Interface Science Co., Ltd.) by a point contact method using a stainless ball as a terminal at 50 g load and 10 mm stroke.

(2) Chloroform-Insoluble Compound

A liquid solution in which about 1.0 g of a binder resin is fully dissolved with about 50 g of chloroform is centrifuged and filtered through a fifth grade quantitative filter paper of JIS standard at a normal temperature. A residue in the filter paper is weighed after dried and a weight ratio between a resin used in the toner and the residue is determined. When chloroform-insoluble compounds in the binder resin in the toner is measured, the same method and a thermal analysis are used except for using 1.0 g of the toner and reducing those of the pigment because the residue includes solid materials such as pigments.

(3) Volume-average Particle Diameter

An interface(from Nikkaki-Bios Co., Ltd.) producing a number and volume distribution, and a personal computer PC9801 (from NEC Corporation) are connected with the Coulter counter TAII from Coulter Electronics, Inc. A battery electrolyte is an aqueos solution including 1% of NaCl using a primary natrium chloride. The measurement is performed as follows:

(a) a surfactant, preferably alkylbenzenesulfonic salt from 0.1 to 5 ml as a dispersant and a toner sample of from 1 to 10 mg are included in the above-mentioned battery electrolyte of from 50 to 100 ml;

(b) the mixture is dispersed by an ultrasonic disperser for a minute and included in the battery electrolyte of from 100 to 200 ml in another beaker until the sample mixture has a predetermined concentration;

(c) the particle distribution of 30,000 particles having a particle diameter of from 2 to 40 μm on a number basis is measured by the above-mentioned Coulter counter TAII using an aperture of 100 μm; and (d) the volume and the number distribution of the particles are calculated to determine the volume-average particle diameter (D4: a medium value of each channel is considered to be the representative of the channel) on a weight basis by the volume distribution.

(4) Synthesis Example of the Zirconium Compound 4 mol of 3,5-di-t-butylsalicylic acid and caustic soda were dissolved in water. A liquid solution of including 1 mol of zirconium chloride was dropped in the mixture while being stirred to form a crystalline of the zirconium compound in the liquid solution. Then the liquid was filtered, and the crystalline was washed, dried and pulverized to prepare a white powder of the zirconium compound.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The following materials are mixed by a Henshel mixer and kneaded by a roll mill upon application of heat at 140° C. for 30 min; the kneaded mixture is cooled at a room temperature; the mixture is pulverized by a jet mill or a mechanical pulverizer; and the pulverized mixture is classified by a wind classifier to prepare a mother toner.

| | |
|---|---|
| Polyester resin A (chloroform-insoluble compounds 3%) | 20 |
| Styrene acrylic resin | 80 |
| Polyethylene wax B (average particle diameter 900 μm) | 15 |
| Carbon black (#44 from Mitsubishi Kasei Corp.) | 10 |
| Zirconium compound (zirconium salicylate complex) | 0.5 |

1.0% by weight of a hydrophobic silica is included in the mother toner to prepare a final toner. (A/B×100=3.3)

Three grams of the thus prepared toner is put into a tablet forming dice and a pressure of 6 tons is applied thereto for 1 min to prepare a tabular toner pellet having a diameter of 40 mm.

The static friction coefficient of the pellet is measured by the above-mentioned automatic friction and abrasion analyzer (DFPM-SS manufactured by Kyowa Interface Science Co., Ltd.) by a point contact method using a stainless ball as a terminal at 50 g load and 10 mm stroke.

A ferrite carrier which is not coated with a resin is mixed with the toner such that the toner has a concentration of 4.0% by weight to prepare a two-component developer.

The developer is set in a copier Imagio 2730 from Ricoh Company, Ltd. to perform the following evaluations:

Filming

After 100,000 copies (printed area 6%) are produced, whether filming over the photoreceptor occurr is visually observed. At the same time, a half-tone image of 1 dot×1 dot is also produced to observe whether white stripes occurr. The filming over the photoreceptor is classified into 5 ranks, and the better the higher.

As for half-tone white stripes, no stripe is ○; occur but acceptable is □; and not acceptable is ×.

Background Fouling

After 100,000 copies are produced, an A3 size image is produced using a blank original. Image density of random 6 parts of the image is measured by a Macbeth reflection densitometer and image density of the blank image is reduced from the average image density of the 6 parts. The difference is classified into the following 5 ranks, and the larger the worse.

Good □: less than 0.1
○: from 0.1 to less than 0.2
□: from 0.2 to less than 0.3
Δ: from 0.3 to less than 0.4
Poor ×: greater than 0.4

Spent

After 300,000 copies are produced, the toner is removed from the developer by a blow-off method and the remaining carrier (weight: W1) is included in toluene to dissolve adhered materials thereto. Then, the carrier is washed and dried, and the weight thereof is measured (W2). The spent ratio is determined as follows:

% by weight=□(W1−W2)/W1□×100

Good □: 0 to less than 0.02% by weight
○: from 0.02 to less than 0.05% by weight
Δ: from 0.05 to less than 0.08% by weight
Poor ×: greater than 0.08% by weight Heat Resistant Preservability 20 g of the toner sample is put in a glass bottle having a capacity of 20 ml, and the sample is left in a bath having a temperature of 60 □ for 4 hrs. Then, the penetration is measured by a penetration test method (IS K2234-1991) as follows:

Good □: not less than 10 mm
○: 9.9 to 5 mm
Δ: 4.9to 3 mm
Poor ×: 2.9 to 0 mm

Fixability

Ricoh Paper Type 6200 is set in a copier MF-200 from Ricoh Company. Ltd., which is equipped with a teflon roller for the fixing roller and having a modified fixer to perform a coping test. The fixing temperature is changed to determine a temperature at which hot offset occurs. The evaluation conditions of cold and hot offset resistance are as follows:

| | |
|---|---|
| Cold Offset Paper feeding linear speed: | 140 mm/sec |
| Surface pressure: | 1.2 Kgf/cm$^2$ |
| Nip width: | 3 mm |
| Hot offset Paper feeding linear speed: | 50 mm/sec |
| Surface pressure: | 2.0 Kgf/cm$^2$ |
| Nip width: | 4.5 mm |

Temperatures at which cold and hot offset occur are classified into the following 5 ranks.

Cold offset

Good □: lower than 125° C.
○: from 125 to lower than 135° C.
□: from 135 to lower than 145° C.
□: from 145 to lower than 155° C.
Poor ×: not lower than 155° C.

Hot offset

Good □: not lower than 201° C.

○: from 200 to 191° C.

□: from 190 to 181° C.

□: from 180 to 171° C.

Poor ×: not higher than 170° C.

Comparative Example 1

The procedures for preparation and evaluation of the toner and developer of Example 1 are repeated except that the polyethylene wax is changed to 20 parts by weight. (A/B×100=2.5)

Comparative Example 2

The procedures for preparation and evaluation of the toner and developer of Example 1 are repeated except that the polyethylene wax is changed to 4 parts by weight and the zirconium compound is changed to 2.5 parts by weight. (A/B×100=62.5)

Example 2

The procedures for preparation and evaluation of the toner and developer of Example 1 are repeated except that the kneading temperature and mixing rotating number of the roll mill are changed to change the surface friction coefficient of the toner randomly. (A/B×100=3.3)

Example 3

The procedures for preparation and evaluation of the toner and developer of Example 2 were repeated except that the polyethylene wax is changed to 4.5 parts by weight and the zirconium compound is changed to 1.0 part by weight. (A/B×100=22.2)

Example 4

The procedures for preparation and evaluation of the toner and developer of Example 3 were repeated except that the kneading temperature and the rotation number in kneading by a roll mill, and pulverizing conditions were changed. (A/B×100=22.2)

Example 5

The procedures for preparation and evaluation of the toner and developer of Example 4 were repeated except that the polyethylene wax was changed to de-free fatty acid carnauba wax.

Example 6

The procedures for preparation and evaluation of the toner and developer of Example 1 were repeated except that the formulation of preparing the mother toner is changed as follows:

| | |
|---|---|
| Polyester resin B (chloroform-insoluble compounds 25%) | 20 |
| Styrene acrylic resin | 80 |
| De-free fatty acid carnauba wax | 4.5 |
| Carbon black (#44 from Mitsubishi Kasei Corp.) | 10 |
| Zirconium compound | 1 |

Example 7

The procedures for preparation and evaluation of the toner and developer of Example 1 were repeated except that the formulation was changed to that of Example 6 and pulverizing and classifying methods were changed.

Example 8

The procedures for preparation and evaluation of the toner and developer of Example 1 are repeated except that the formulation of preparing the mother toner is changed as follows:

| | |
|---|---|
| Polyester resin B (chloroform-insoluble compounds 25%) | 40 |
| Styrene acrylic resin | 60 |
| De-free fatty acid carnauba wax | 5 |
| Carbon black (□44 from Mitsubishi Kasei Corp.) | 10 |
| Zirconium compound | 1 |

Example 8

The procedures for preparation and evaluation of the toner and developer of Example 8 are repeated except that the carrier is changed to a magnetite particles having an average particle diameter of 50 μm, which is coated with a silicone resin (coated layer thickness 0.5 μm).

The volume-average particle diameter(μm), the amount of fine particles having a particle diameter not greater than 5 μm (% by number), the chloroform-insoluble compounds(% by weight), the surface friction coefficient of the toners of Example 1 to 9 and Comparative Examples 1 to 3 in addition to the results of the evaluations thereof are shown in Table 1.

TABLE 1

| | A/B × | | | | | FL | | | | | FX | |
|---|---|---|---|---|---|---|---|---|---|---|---|---|
| | 100 | VAPD | AFP5 | CIC | SFC | FP | WH | HRP | SP | BF | LTFX | HOR |
| Ex. 1 | 3.3 | 9.5 | 30 | 0 | 0.18 | 3.5 | Δ | ○ | Δ | ○ | □ | ○ |
| Ex. 2 | 3.3 | 9 | 50 | 0 | 0.21 | 4 | ○ | ○ | Δ | ○ | □ | ○ |
| Ex. 3 | 22.2 | 9 | 45 | 0 | 0.25 | 4 | ○ | ○ | ◎ | ○ | □ | ○ |
| Ex. 4 | 22.2 | 8.5 | 20 | 0 | 0.29 | 4 | ○ | ◎ | ○ | ○ | □ | ○ |
| Ex. 5 | 22.2 | 7.2 | 30 | 0 | 0.3 | 4 | ○ | ◎ | ○ | ○ | ○ | ○ |
| Ex. 6 | 22.2 | 7.5 | 20 | 10 | 0.31 | 4.5 | ○ | ◎ | ○ | ○ | ○ | ◎ |

TABLE 1-continued

| | A/B × 100 | VAPD | AFP5 | CIC | SFC | FL FP | FL WH | HRP | SP | BF | FX LTFX | FX HOR |
|---|---|---|---|---|---|---|---|---|---|---|---|---|
| Ex. 7 | 22.2 | 6.5 | 68 | 10 | 0.33 | 4.5 | ○ | ◎ | ○ | ◎ | ○ | ◎ |
| Ex. 8 | 22.2 | 6.5 | 70 | 15 | 0.32 | 4.5 | ○ | ◎ | ○ | ◎ | ◎ | ◎ |
| Ex. 9 | 22.2 | 6.5 | 70 | 15 | 0.32 | 4.5 | ○ | ◎ | ◎ | ◎ | ◎ | ◎ |
| Com. Ex. 1 | 2.5 | 9.5 | 15 | 0 | 0.16 | 1 | x | x | x | x | ○ | ○ |
| Com. | 62.5 | 9.5 | 20 | 0 | 0.35 | 4 | ○ | ○ | ◎ | x | □ | x |
| Com. Ex. 3 | 3.3 | 9.5 | 30 | 0 | 0.18 | 3.5 | Δ | x | x | x | □ | x |

VAPD: Volume-average particle diameter (μm)
AFP5: Amount of fine particles having a particle diameter not greater than 5 μm (% by number)
CIC: Chloroform-insoluble compounds (% by weight)
SFC: Surface friction coefficient of the toner
FL: Filming
FP: Filming over the photoreceptor
WH: White stripe on the half-tone image
HRP: Heat resistant preservability
SP: Spent
BF: Background fouling
FX: Fixability
LTFX: Low temperature fixability
HOR: Hot offset resistance Preferred species corresponding to the portion of Formula (1) denoted by "r" include:

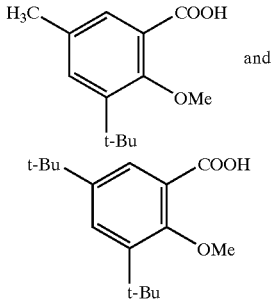

In addition, other charge controlling agents such as nigrosin dyes, metal complex dyes and quaternary ammonium salts can be used alone or in combination. The negative charge controller includes metallic salts of mono azo dyes, salicylic acid, metal complex of dicarboxylic acid, etc. The content of the charge controller is preferably from 0.1 to 10 parts by weight, more preferably from 1 to 5 parts by weight per 100 parts by weight of the resin included in the toner.

This document claims priority and contains subject matter related to Japanese Patent Applications Nos. 2001-151166 and 2001-174846, filed on May 21, 2001 and Jun. 8, 2001 respectively, both incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

a binder resin;

a colorant;

a charge controlling agent; and a wax (B), wherein the charge controlling agent comprises:

a zirconium compound A that is a reaction product of a compound selected from the group consisting of aromatic oxycarboxylic acids, derivatives of aromatic oxycarboxylic acids, salts of aromatic oxycarboxylic acids and salts of derivatives of aromatic oxycarboxylic acids with a compound comprising zirconium or oxyzirconium), and wherein a weight ratio (A/B) of the zirconium compound (A) to the wax (B) satisfies the following relationship:

$$3.0 \leqq (A/B) \times 100 \leqq 60.0.$$

2. The toner of claim 1, wherein the zirconium compound has the following formula (1):

(1)

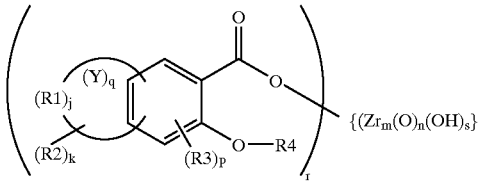

wherein R1 represents a quaternary carbon atom, a methine group or a methylene group, and optionally includes a hetero atom of N,S,O and P; Y represents a group having a ring comprising a saturated bonding or unsaturated bonding; R2 and R3 independently represent an alkyl group, an alkenyl group, an alkoxy group, an aryl group, a substituted aryl group, an aryloxy group, a substituted aryloxy group, an aralkyl group, a substituted aralkyl group, an aralkyloxy group, or a substituted aralkyloxy group, a halogen group, a hydroxy group, an amino group, a substituted amino group, a carboxyl group, an alkoxycarbonyl group, a nitro group, a nitroso group, a sulfonyl group or a cyano group; R4 represents a hydrogen atom or an alkyl group; j is 0 or an integer of from 3 to 12; k is 0 or an integer of from 1 to 4; m is an integer of from 1 to 20; n is 0 or an integer of from 1 to 20; p is 0 or an integer of from 1 to 4; q is 0 or an integer of from 1 to 3; r is an integer of from 1 to 20; and s is 0 or an integer of from 1 to 20.

3. An electrophotographic image forming method comprising:

irradiating a photoreceptor rotating at a speed of from 150 to 760 mm/sec with light to form an electrostatic latent image on the photoreceptor;

agitating a developer comprising a toner;

developing the electrostatic latent image with the developer to form a toner image on the photoreceptor;

transferring the toner image onto a transfer sheet; and fixing the toner image on the transfer sheet upon application of heat and pressure without using an oil to produce a copy, wherein the fixing pressure is not greater than $1.5\times10^5$ Pa, and wherein the developer is agitated for not less than 4 seconds when only the copy is produced, wherein the agitation time is 2 to 8 times when the copy is continuously produced, and wherein the toner is the toner according to claim 2.

4. The toner of claim 2, wherein r in Formula 1 is selected from the group consisting of

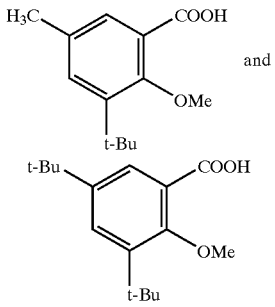

5. The toner of claim 1, wherein when the toner is in the form of a pressed tablet, and the tablet has a surface friction coefficient of from 0.2 to 0.4.

6. An electrophotographic image forming method comprising:

irradiating a photoreceptor rotating at a speed of from 150 to 760 mm/sec with light to form an electrostatic latent image on the photoreceptor;

agitating a developer comprising a toner;

developing the electrostatic latent image with the developer to form a toner image on the photoreceptor;

transferring the toner image onto a transfer sheet; and fixing the toner image on the transfer sheet upon application of heat and pressure without using an oil to produce a copy, wherein the fixing pressure is not greater than $1.5\times10^5$ Pa, and wherein the developer is agitated for not less than 4 seconds when only the copy is produced, wherein the agitation time is 2 to 8 times when the copy is continuously produced, and wherein the toner is the toner according to claim 5.

7. The toner of claim 1, wherein the wax is present in the toner in an amount not greater than 5% by weight based on total weight of the binder resin.

8. An electrophotographic image forming method comprising:

irradiating a photoreceptor rotating at a speed of from 150 to 760 mm/sec with light to form an electrostatic latent image on the photoreceptor;

agitating a developer comprising a toner;

developing the electrostatic latent image with the developer to form a toner image on the photoreceptor;

transferring the toner image onto a transfer sheet; and fixing the toner image on the transfer sheet upon application of heat and pressure without using an oil to produce a copy, wherein the fixing pressure is not greater than $1.5\times10^5$ Pa, and wherein the developer is agitated for not less than 4 seconds when only the copy is produced, wherein the agitation time is 2 to 8 times when the copy is continuously produced, and wherein the toner is the toner according to claim 7.

9. The toner of claim 1, wherein the wax has a number-average particle diameter of from 0.1 to 1.5 $\mu$m.

10. An electrophotographic image forming method comprising:

irradiating a photoreceptor rotating at a speed of from 150 to 760 mm/sec with light to form an electrostatic latent image on the photoreceptor;

agitating a developer comprising a toner;

developing the electrostatic latent image with the developer to form a toner image on the photoreceptor;

transferring the toner image onto a transfer sheet; and fixing the toner image on the transfer sheet upon application of heat and pressure without using an oil to produce a copy, wherein the fixing pressure is not greater than $1.5\times10^5$ Pa, and wherein the developer is agitated for not less than 4 seconds when only the copy is produced, wherein the agitation time is 2 to 8 times when the copy is continuously produced, and wherein the toner is the toner according to claim 9.

11. The toner of claim 1, wherein the wax comprises at least one of carnauba wax, montan wax and oxidized rice wax.

12. An electrophotographic image forming method comprising:

irradiating a photoreceptor rotating at a speed of from 150 to 760 mm/sec with light to form an electrostatic latent image on the photoreceptor;

agitating a developer comprising a toner;

developing the electrostatic latent image with the developer to form a toner image on the photoreceptor;

transferring the toner image onto a transfer sheet; and fixing the toner image on the transfer sheet upon application of heat and pressure without using an oil to produce a copy, wherein the fixing pressure is not greater than $1.5\times10^5$ Pa, and wherein the developer is agitated for not less than 4 seconds when only the copy is produced, wherein the agitation time is 2 to 8 times when the copy is continuously produced, and wherein the toner is the toner according to claim 11.

13. The toner of claim 1, wherein the toner further comprises a chloroform-insoluble compound in an amount of from 2 to 45% by weight based on total weight of the toner.

14. An electrophotographic image forming method comprising:

irradiating a photoreceptor rotating at a speed of from 150 to 760 mm/sec with light to form an electrostatic latent image on the photoreceptor;

agitating a developer comprising a toner;

developing the electrostatic latent image with the developer to form a toner image on the photoreceptor;

transferring the toner image onto a transfer sheet; and fixing the toner image on the transfer sheet upon application of heat and pressure without using an oil to produce a copy, wherein the fixing pressure is not greater than $1.5\times10^5$ Pa, and wherein the developer is agitated for not less than 4 seconds when only the copy is produced, wherein the agitation time is 2 to 8 times when the copy is continuously produced, and wherein the toner is the toner according to claim 13.

15. The toner of claim 1, wherein the toner is in the form of particles such that particles of the toner have a volume-average particle diameter of from 5 to 10 $\mu$m and a content of the toner particles having a particle diameter not greater than 5 $\mu$m in the toner is 60 to 80% by number.

16. The toner of claim 1, wherein the binder resin comprises a polyester resin in an amount not less than 30% by weight based on total weight of the binder resin.

17. The toner of claim 1, wherein the charge controlling agent comprises a compound selected from the group consisting of aromatic oxycarboxylic acids and salts thereof.

18. An electrophotographic image forming method comprising:

irradiating a photoreceptor rotating at a speed of from 150 to 760 mm/sec with light to form an electrostatic latent image on the photoreceptor;

agitating a developer comprising a toner;

developing the electrostatic latent image with the developer to form a toner image on the photoreceptor;

transferring the toner image onto a transfer sheet; and fixing the toner image on the transfer sheet upon application of heat and pressure without using an oil to produce a copy, wherein the fixing pressure is not greater than $1.5\times10^5$ Pa, and wherein the developer is agitated for not less than 4 seconds when only the copy is produced, wherein the agitation time is 2 to 8 times when the copy is continuously produced, and wherein the toner is the toner according to claim 17.

19. A two-component developer comprising the toner according to claim 1 and a carrier.

20. The two-component developer of claim 19, wherein the carrier has a surface coated with a silicone resin.

21. An electrophotographic image forming method comprising:

irradiating a photoreceptor rotating at a speed of from 150 to 760 mm/sec with light to form an electrostatic latent image on the photoreceptor;

agitating a developer comprising a toner;

developing the electrostatic latent image with the developer to form a toner image on the photoreceptor;

transferring the toner image onto a transfer sheet; and fixing the toner image on the transfer sheet upon application of heat and pressure without using an oil to produce a copy, wherein the fixing pressure is not greater than $1.5\times10^5$ Pa, and wherein the developer is agitated for not less than 4 seconds when only the copy is produced, wherein the agitation time is 2 to 8 times when the copy is continuously produced, and wherein the toner is the toner according to claim 1.

22. The toner of claim 1, wherein said zirconium compound A is a reaction product of a compound selected from the group consisting of 3,5-di-t-butylsalicylic acid, 3,5-di-i-propylsalycilic acid, 5-methoxysalicylic acid, 3,5-dichlorosalicylic acid, 3-t-butyl-5-methylsalicylic acid, 2-hydroxy-3-naphthoic acid, and 2-hydroxy-6-t-butyl-3-naphthoic acid with a compound selected from the group consisting of $ZrCl_4$, $ZrF_4$, $ZrBr_4$ and $ZrI_4$, $Zr(SO_4)_2$, $ZrOCl_2$, $ZrO(NO_3)_2$, $ZrO(ClO_4)_2$, $H_2ZrO(SO_4)_2$, $ZrO(SO_4)\bullet Na_2SO_4$, $ZrO(HPO_4)_2$, $ZrO(CO_3)$, $(NH_4)_2ZrO(CO_3)_2$, $(NH_4)_2ZrO(C_2H_3O_2)_2$, $ZrO(C_2H_{35}O_2)_2$ and $ZrO(C_{18}H_{35}O_2)_2$.

23. The toner of claim 1, wherein said zirconium compound A is prepared by reacting 3,5-di-t-butylsalicylic acid, caustic soda, and zirconium chloride.

* * * * *